United States Patent [19]

Latassa

[11] 4,009,412

[45] Feb. 22, 1977

[54] FLUORESCENT LAMP BALLAST CIRCUIT WITH MAGNETIC SWITCH

[75] Inventor: Frank M. Latassa, Magnolia, Mass.

[73] Assignee: GTE Sylvania Incorporated, Danvers, Mass.

[22] Filed: Dec. 11, 1975

[21] Appl. No.: 640,023

[52] U.S. Cl. ..... 315/106; 315/94; 315/119; 315/278; 315/DIG. 5

[51] Int. Cl.[2] ..... H05B 41/23

[58] Field of Search ..... 315/94, 102, 106, 107, 315/119, 278, DIG. 5

[56] References Cited

UNITED STATES PATENTS

| | | | |
|---|---|---|---|
| 2,317,602 | 4/1943 | Hall, Jr. et al. | 315/106 X |
| 2,330,312 | 9/1943 | Raney, Jr. | 315/278 X |
| 2,668,259 | 2/1954 | Stutsman | 315/106 X |

*Primary Examiner*—Eugene R. LaRoche
*Attorney, Agent, or Firm*—James H. Grover

[57] ABSTRACT

A rapid start fluorescent lamp ballast with a secondary winding supplying lamp current and tertiary windings for supplying heater current, has a magnetic switch which senses current through the secondary winding and opens the heater current circuit after the lamp starts and draws operating current from the secondary winding. The current sensing magnetic switches shown are a slow acting relay with its coil in the secondary circuit and a magnetic reed switch physically disposed in the magnetic field of the secondary ballast winding.

6 Claims, 3 Drawing Figures

FLUORESCENT LAMP BALLAST CIRCUIT WITH MAGNETIC SWITCH

BACKGROUND OF THE INVENTION

Commonly used fluorescent lamp ballast are of the rapid start type which includes a transformer primary winding and a secondary winding supplying operating current to the lamp, and also one or more heater windings which supply current through the filaments at each end of the fluorescent lamp. The heating current is supplied when power is switched on to the ballast and resistively heats the filaments to emmissive state. In this state a relatively low voltage, and hence a smaller and less expensive ballast, is needed to ignite an arc across the lamp. Heating the filaments protects them from damage which would occur with cold ignition, and prolongs lamp life.

The rapid start ballast circuit has the disadvantage that heater current continues to flow when not needed after the lamp starts, and accordingly it is an object of the invention to eliminate the waste of continuous heater current while retaining the advantages of rapid starting.

STATEMENT OF INVENTION

According to the invention a rapid start ballast for a fluorescent lamp comprises primary lamp terminals for carrying lamp current, secondary lamp terminals for supplying heating current to the lamp filaments, a transformer including a primary winding for alternating line current, a secondary winding with a connection to the primary lamp terminals, and a tertiary winding in a circuit to the secondary lamp terminals, and means for sensing current in the secondary winding and connection, including switching means in the tertiary winding circuit for opening the tertiary circuit after the lamp starts and draws operating current from the secondary winding.

According to a further aspect of the invention the current sensing means comprises electromagnetic switching means responsive to current through the secondary transformer winding, such as a relay with its coil in the secondary winding connection and a switch in the tertiary winding circuit, or preferably a magnetic reed switch physically disposed in the magnetic field of the secondary winding.

DRAWINGS

DESCRIPTION

Figure 1:
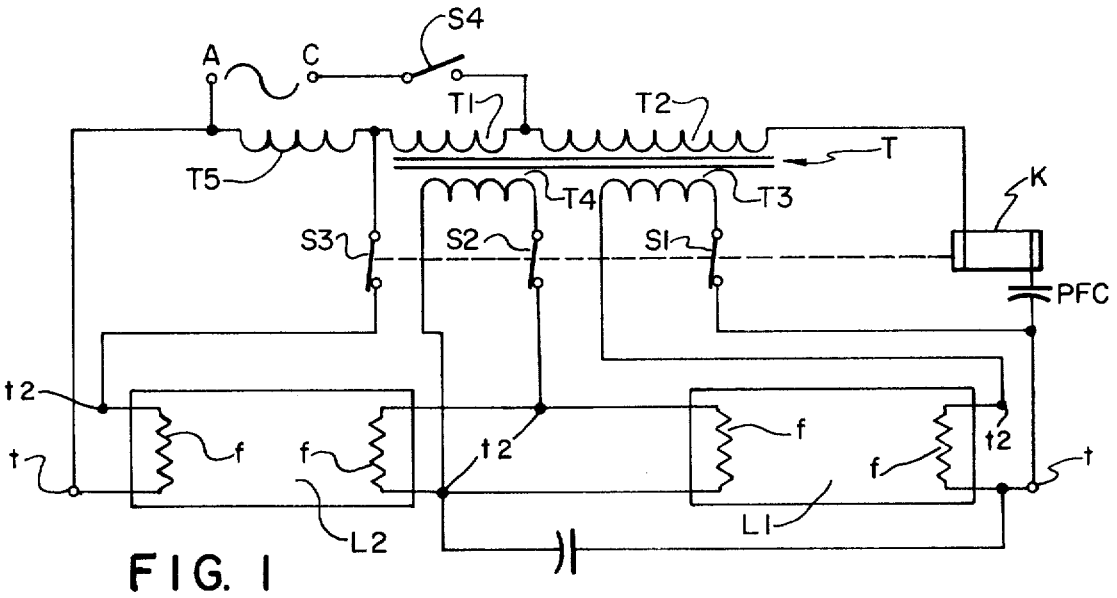
FIG. 1 is a schematic diagram of a rapid start ballast circuit with a switching relay.

The rapid start ballast circuit of FIG. 1 comprises a transformer T having a primary winding T1 connected through an on-off switch S4 to alternating current line terminals A and C. A secondary winding T2 has connections through a power factor correcting capacitor PFC to one primary terminal *t* for two fluorescent lamps L1 and L2 and also through the primary winding to another primary lamp terminal *t*. The lamp terminals *t* supply operating current for the lamps after they have started arc discharge, and also act as secondary lamp terminals. Tertiary windings T3, T4 and T5 supply low voltage heating current to secondary terminals *t*2 for filaments *f* in pairs at the ends of the two lamps L1 and L2, the filaments being emissively coated to support arc discharge between filaments.

The rapid start ballast circuit as so far described, omitting switches S1, S2 and S3, is of conventional design and operation. Closing the on-off switch S4 supplies line current to the transformer primary T1 and induces current in the secondary T2 and tertiary windings T3, T4, T5. The tertiary winding current rapidly, e.g. in 2 seconds, heats the filaments to emissive state whereupon an arc may strike between each pair of filaments. Once the arc is ignited the heating current in conventional rapid start ballast circuits is not required but continues to flow. On the average approximately 7% to 9% of the total lamp and ballast wattage consumption is wasted in such a prior circuit for two 40 watt rapid start lamps. It may be possible to open the filament heating circuits by thermally or otherwise sensing the heating current, but such a system would not assure that the lamps have properly started and will continue burning.

According to the invention as embodied in FIG. 1 the coil K of a relay is connected in the secondary winding circuit to the primary lamp terminals, the relay actuating normally closed switches S1, S2 and S3 to open position only when current supplied from the secondary T2 through the lamps L1, L2 and the relay coil K reaches the rated operating lamp current value after ignition. For example, two 40 watt rapid start lamp draw approximately 430 milliamperes rated current. The relay is of the inherent time delay or slow acting type, responding slower than lamp current increase and opening the switches S1, S2, S3 approximately one or two seconds after rated lamp current is reached, whereupon the relay interrupts the heating currents. By sensing lamp current, and also sensing rated lamp current and introducing a time delay, it is insured that the lamp has reliably started before filament heating current is interrupted. Furthermore, since lamp current is sensed, the relay will automatically restore heating current for restarting in the event power and lamp current are intentionally or otherwise interrupted.

Because the relay coil draws only a minor fraction (e.g. 1%) of the 7% to 9% power saved by opening the filament heating circuit, the net saving is substantial in the art of fluorescent lamps where a 3% to 5% saving is considered significant.

Figure 2:
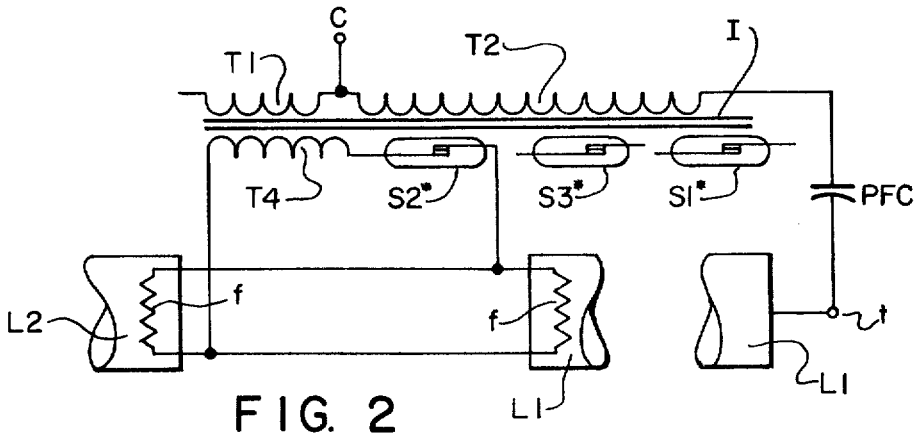
FIG. 2 is a schematic diagram like FIG. 1 with magnetic reed switches.
Figure 3:
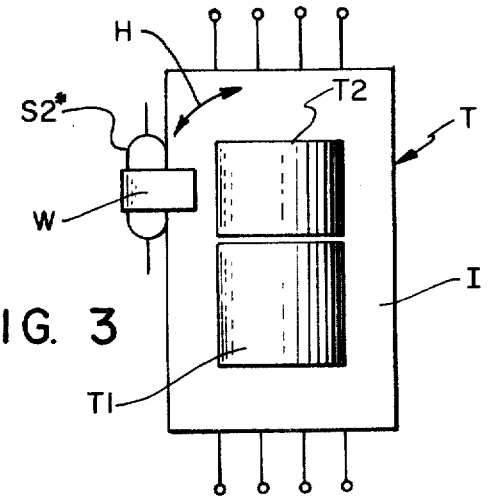
FIG. 3 is an elevation of the ballast transformer of FIG. 2 mounting magnetic reed switches.

Substantially all of the 7% to 9% saving can be realized by the circuit and structure of FIGS. 2 and 3. The ballast circuit of FIG. 3 is the same as that of FIG. 1 excepting that the relay coil K of FIG. 1 is omitted and the relay switches of FIG. 1 are, in FIG. 2, replaced by magnetic reed switches S1*, S2* and S3*. Further according to the invention the reed switches are physically mounted on the iron core I of the ballast transformer T in the magnetic field H of the secondary winding T2. Magnetic leakage extends outside the core I sufficient to operate a properly selected reed switch, for example a Hamlin Inc. type MLC-DT-186. With the lamps drawing rated current the position of reed switches on the core I adjacent the secondary T2 may be adjusted until they open positively. They may then be secured to the core I by an adhesive tape or web W. Thereafter the reed switches consume no power but can be opened by magnetically sensing the secondary winding current supplied at rated operating value to the lamps L1 and L2.

It should be understood that the present disclosure is for the purpose of illustration only and that this invention includes all modifications and equivalents which fall within the scope of the appended claims.

I claim:

1. A rapid start ballast circuit for a fluorescent lamp comprising:

primary lamp terminals for carrying lamp current, secondary lamp terminals for supplying heating current to the lamp filaments, a transformer including a primary winding for alternating line current, a secondary winding with connection for supplying lamp current to the primary lamp terminals, and a tertiary winding in a circuit to the secondary lamp terminals, and magnetic field sensing means responsive to the magnetic field of lamp current in the secondary winding and connection, including switching means in the tertiary winding circuit for opening the tertiary circuit after the lamp starts and draws operating current from the secondary winding.

2. A circuit according to claim 1 wherein the sensing means is a magnetic reed switch disposed in the magnetic field of the secondary winding and comprising the switching means in the tertiary circuit.

3. A circuit according to claim 2 wherein the transformer includes a core of magnetic material and the reed switch is mounted on the core.

4. A rapid start ballast for a fluorescent lamp having a heated filament comprising a transformer including a magnetic core, a primary winding on the core for connection to an alternating current line, a secondary winding on the core for connection across the lamp, a tertiary winding for connection to the lamp filament, and a magnetic switch disposed in the magnetic field of the secondary winding and electrically connected to the tertiary winding, the switch being responsive to the magnetic field of lamp current in the secondary winding and including switching means connected to the tertiary winding to open a circuit through the tertiary winding to the lamp filament.

5. A ballast according to claim 4 wherein the sensing means is a magnetic reed switch disposed in the magnetic field of the secondary winding and comprising the switching means in the tertiary circuit.

6. A ballast according to claim 5 wherein the transformer includes a core of magnetic material and the reed switch is mounted on the core.

* * * * *